United States Patent [19]

Grasnianski

[11] 3,950,973

[45] Apr. 20, 1976

[54] FLAT KEY

[75] Inventor: Serge Grasnianski, Grenoble, France

[73] Assignee: Kis France, France

[22] Filed: Feb. 3, 1975

[21] Appl. No.: 546,759

Related U.S. Application Data

[62] Division of Ser. No. 418,223, Nov. 23, 1973.

[30] Foreign Application Priority Data

Apr. 24, 1973 France ..... 73.14753
June 20, 1973 France ..... 73.22467

[52] U.S. Cl. ..... 70/395; 70/408
[51] Int. Cl.[2] ..... E05B 19/04
[58] Field of Search ..... 70/393, 395, 408, 405, 70/406

[56] References Cited

UNITED STATES PATENTS

| | | | |
|---|---|---|---|
| 2,197,673 | 4/1940 | Albertz | 70/395 |
| 3,349,589 | 10/1967 | Fricke | 70/395 |
| 3,729,965 | 5/1973 | Gartner | 70/395 |

*Primary Examiner*—Robert L. Wolfe
*Attorney, Agent, or Firm*—Robert E. Burns; Emmanuel J. Lobato; Bruce L. Adams

[57] ABSTRACT

A flat key comprises a blank cut on a copying machine to form a shank, having a shank head. An intermediate head is formed with a slot, in which the shank head is received. A key head is detachably connected with the intermediate head, with wedge action between these latter heads.

5 Claims, 2 Drawing Figures

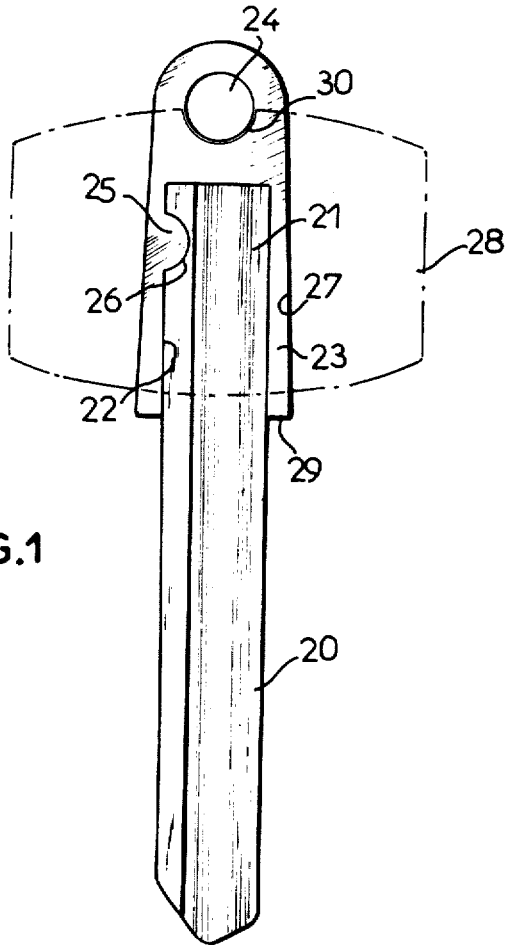
FIG.1
FIG.2
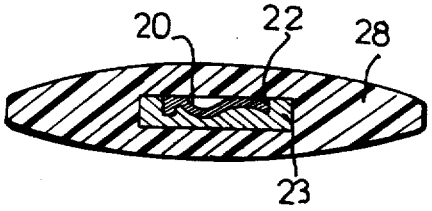

FLAT KEY

This is a division of application Ser. No. 418,223, filed Nov. 23, 1973.

BACKGROUND OF THE INVENTION

This invention relates to a flat key.

Known flat keys are cut on copying machines from a blank consisting of a shank or core which is milled on the machine in accordance with the profile of a specimen key, and of a head whose shape varies according to the lock manufacturer and which can be round, triangular, octogonal, rectangular, etc., this head comprising a hole for fastening the key to a ring, a key board or a hook. In general, lock manufacturers make their keys for one and the same type of lock with the same blank for the shank, although keys differing in the shape of their heads can be used for one and the same type of lock. Accordingly, manufacturers concerned with the production of replacement keys and specialising in copying keys from specimens presented to them are faced with the need to stock a large number of blanks in order to be able to reproduce the flat keys for every type of lock, this stock being further multiplied for commercial reasons by a certain number of decorative finishes for one and the same type of bland, namely nickel finishes, gold finishes or various coloured finishes. For example, if the locksmith has to keep a stock of "N" types of key to meet the requirements of his customers, he has to multiply this stock by "*n*" different decorative finishes.

Flat keys are already known which consist of two rigidly assembled parts, namely a shank having a head substantially equal in width to the shank, and an operating head which can assume any one of a number of external forms. The main advantage of manufacturing flat keys in this way is that it is possible for the operating heads to be made of an optionally castable material or of a material sufficiently soft to be able to receive impressions corresponding to the necessary references and marks or even decorative patterns (key heads in the form of medals, old or new coins, etc.), which gives rise to difficulties in the case of a key blank cut in one piece from sheet steel. In addition, it is possible, by making separate operating heads of plastics materials, to produce these heads in different colours.

In contrast, if as has hitherto been proposed, the keys have separate metal heads welded or crimped on to the shank, or plastics heads mounted on the end of the key blank, the shank or blank can only be assembled with the head in a factory and not by the locksmith or the key cutter who does not have the special machinery or equipment required. Accordingly, locksmiths and key cutters have to keep a large variety of blanks in stock. An object of this invention is to obviate this disadvantage.

BRIEF SUMMARY OF THE INVENTION

The flat key according to the invention, consisting of several normally rigidly assembled parts, is distinguished by the fact that an intermediate head on the key shank is wedge-shaped with a very gradual taper, and by the fact that the key head comprises a slot of corresponding shape into which the intermediate head is fitted.

Accordingly, the key according to the invention can readily be assembled by the locksmith or key cutter without any need for special equipment. In addition, the key assembly, although perfectly rigid in normal use, can be readily taken apart so that it is possible for example to change the shank of the key without changing the head which can be of advantage in cases where locks are changed, when moving house or when changing vehicles. Finally, the blank manufacturer can limit the number of specimens in stock to that of the types of key available on the market without having to make any allowances for the shape of the key heads.

Key manufacture can be standardized even further through the production of separate key heads which can be adapted to fit any flat key blanks irrespective in particular of their width. The wedge action is advantageously provided between the intermediate component and the key head. The intermediate component can have a groove with parallel edges in which is engaged the end of a shank of uniform width.

It will be appreciated that, under these circumstances, it is sufficient to keep in stock several specimens of inexpensive intermediate components all of which have the same shape and the same external dimensions and in which only the width of the grooves is different, with the result that standardized heads comprising the same slot can be fitted to shanks differing in width and profile.

According to another aspect of the invention, this intermediate wedge-shaped component has an end which projectes beyond the key head.

By virtue of the invention, it is possible greatly to simplify the shape of the blanks by providing them with parallel edges over their entire length, so that they can be manufactured not only by stamping a sheet of steel, but also by drawing or extrusion which reduces their manufacturing costs.

BRIEF DESCRIPTION OF DRAWINGS

A preferred embodiment of the invention is described by way of example in the following with reference to the accompanying drawings, wherein:

FIGS. 1 and 2 are, respectively, a side elevation of and a cross-section through an embodiment of the invention.

DESCRIPTION OF THE PREFERRED EMBODIMENT

As shown in FIGS. 1 and 2, the key according to the invention consists of a shank 20 which is obtained by drawing or extrusion and which has parallel edges. The rear end 21 of this shank is engaged in a groove 22 with parallel edges formed in an intermediate part 23 which externally is wedge-shaped and at whose end a hole 24 is drilled. At least one of the edges of the groove 22 is formed with a projection 25 engaging in a notch 26 formed in the corresponding edge of the shank 20 so as to lock the shank in the longitudinal direction. The intermediate part with the end 21 of the shank 20 engaged therein has rearwardly slightly tapering edges, wedged in a similarly tapering aperture or slot 27 in the separate key head or operating head 28. The latter head itself can be made in one piece, for example, cast from ZAMAK or from a plastics material, or in two parts joined together by bonding. The front edge 29 of the intermediate part 23 which projects beyond the key head 28 forms the stop for positioning the key in the lock.

The groove 22 in the intermediate component 23 can be open on the two faces of the component 23 or, as shown in FIG. 10, it can have a base whose shape, as seen in cross-section, is complementary to the profile of the cross-section of the shank 20.

The key head 28 is formed in its upper edge with a semi-circular notch 30 coinciding with the inner semi-circumference of the hole 24 of the shank 20.

The invention enables a standard key head to be used for any type of flat key irrespective of its width and profile, because it is sufficient to produce the intermediate components identical in shape and external dimensions which fit the slot in the key head and in which only the groove is different according to the type of shank.

I claim:

1. A flat key comprising;

a shank which comprises a flat and narrow profile section and a substantially similarly flat and narrow shank head;

an intermediate component which has at least one face and a groove therein having edges which engage the shank head, said component being wedge-shaped, with a very gradual taper, on outer surfaces thereof; and a key head surrounding the intermediate component, the key being thicker and wider than said component, having an aperture extending through the key head and slightly tapering to fit the slightly tapering component, with wedge action, to interconnect said key head tightly but removably with said component and thereby with said shank.

2. A flat key as claimed in claim 1, wherein the wedge-shaped intermediate component has an end which projects beyond the key head.

3. A flat key as claimed in claim 1, wherein the edges of the groove of the intermediate component and the shank engaged therein are mutually parallel and at least one of said edges has a projection, the corresponding edge of the shank having a notch engageable by said projection.

4. A flat key as claimed in claim 1, wherein, as seen in cross-section, the groove in the intermediate component has a base having a profile complementary with a corresponding profile of the shank.

5. A flat key as claimed in claim 1, wherein the shank has a portion forwardly extending beyond the intermediate component, said portion and the key head having, near their forward ends, openings which coincide with one another by which the key can be attached to a key ring.

* * * * *

UNITED STATES PATENT OFFICE

CERTIFICATE OF CORRECTION

PATENT NO. : 3,950,973

DATED : April 20, 1976

INVENTOR(S) : Serge CRASNIANSKI

It is certified that error appears in the above-identified patent and that said Letters Patent are hereby corrected as shown below:

The Inventor's last name, noted in line [75] of the front page is CRASNIANSKI, not "Grasnianski".

Signed and Sealed this

Twenty-first Day of September 1976

[SEAL]

*Attest:*

RUTH C. MASON
*Attesting Officer*

C. MARSHALL DANN
*Commissioner of Patents and Trademarks*